US011037708B2

(12) United States Patent
Chen et al.

(10) Patent No.: US 11,037,708 B2
(45) Date of Patent: Jun. 15, 2021

(54) PPTC DEVICE HAVING RESISTIVE COMPONENT

(71) Applicant: Littelfuse, Inc., Chicago, IL (US)

(72) Inventors: Jianhua Chen, Sunnyvale, CA (US); Chun Kwan Tsang, Morgan Hill, CA (US)

(73) Assignee: Littelfuse, Inc., Chicago, IL (US)

( * ) Notice: Subject to any disclaimer, the term of this patent is extended or adjusted under 35 U.S.C. 154(b) by 55 days.

(21) Appl. No.: 16/458,246

(22) Filed: Jul. 1, 2019

(65) Prior Publication Data

US 2021/0005362 A1 Jan. 7, 2021

(51) Int. Cl.

| | |
|---|---|
| ***H01C 7/02*** | (2006.01) |
| ***H01C 1/14*** | (2006.01) |
| ***H01C 7/13*** | (2006.01) |
| ***H01C 13/02*** | (2006.01) |
| ***H01C 17/00*** | (2006.01) |
| ***H01C 17/28*** | (2006.01) |
| ***H01H 85/06*** | (2006.01) |
| ***H01H 85/147*** | (2006.01) |

(52) U.S. Cl.

CPC ..... *H01C 7/028* (2013.01); *H01C 1/1406* (2013.01); *H01C 7/13* (2013.01); *H01C 13/02* (2013.01); *H01C 17/006* (2013.01); *H01C 17/28* (2013.01); *H01H 85/06* (2013.01); *H01H 85/147* (2013.01)

(58) Field of Classification Search

CPC ..... H01C 7/028; H01C 1/1406; H01C 7/13; H01C 13/02; H01C 17/28

USPC ..... 338/20

See application file for complete search history.

(56) References Cited

U.S. PATENT DOCUMENTS

| | | | |
|---|---|---|---|
| 4,017,715 | A | 4/1977 | Whitney et al. |
| 4,238,812 | A | 12/1980 | Middleman et al. |
| 4,924,074 | A | 5/1990 | Fang et al. |
| 5,166,658 | A | 11/1992 | Fang et al. |

(Continued)

FOREIGN PATENT DOCUMENTS

| | | | |
|---|---|---|---|
| DE | 2011103112 | T5 | 6/2013 |
| JP | 2006128277 | A | 5/2006 |

OTHER PUBLICATIONS

European Search Report dated Nov. 12, 2020 for European Patent Application No. 20182501.5.

*Primary Examiner* — Edwin A. Leon
*Assistant Examiner* — Iman Malakooti
(74) *Attorney, Agent, or Firm* — Kacvinsky Daisak Bluni PLLC

(57) ABSTRACT

A PPTC assembly may include a PPTC component, having a trip temperature, and further comprising a first temperature coefficient of resistance, in a low temperature range below the trip temperature. The PPTC assembly may include a resistive component, disposed in electrical contact with the PPTC component on a first side of the PPTC component, the resistive component comprising an electrical conductor, and having a second temperature coefficient of resistance in the low temperature range, less than the first temperature coefficient of resistance. The PPTC component may include a first electrode, electrically coupled to the first side of the PPTC component, and a second electrode, electrically coupled to the second side of the PPTC component, where the PPTC component and the resistive component are arranged in electrical series between the first electrode and the second electrode.

16 Claims, 6 Drawing Sheets

(56) References Cited

U.S. PATENT DOCUMENTS

| | | | | |
|---|---|---|---|---|
| 2006/0176675 | A1 | 8/2006 | Bourns et al. | |
| 2015/0235744 | A1 | 8/2015 | Chen et al. | |
| 2017/0004946 | A1* | 1/2017 | Rutter, Jr. | H01B 1/22 |
| 2018/0315576 | A1* | 11/2018 | Tsang | H01C 17/06586 |
| 2019/0080824 | A1* | 3/2019 | Chen | C08K 3/14 |

* cited by examiner

900

PPTC DEVICE HAVING RESISTIVE COMPONENT

BACKGROUND

Field

Embodiments relate to the field of circuit protection devices, including fuse devices.

Discussion of Related Art

Polymer positive temperature coefficient (PPTC) devices may be used as overcurrent or over-temperature protection device, as well as current or temperature sensors, among various applications. In overcurrent or over-temperature protection applications, the PPTC device may be considered a resettable fuse, designed to exhibit low resistance when operating under designed conditions, such as low current. The resistance of the PPTC device may be altered by direct heating due to temperature increase in the environment of the circuit protection element, or via resistive heating generated by electrical current passing through the circuit protection element. For example, a PPTC device may include a polymer material and a conductive filler that provides a mixture that transitions from a low resistance state to a high resistance state, due to changes in the polymer material, such as a melting transition or a glass transition. At such a transition temperature, sometimes called a trip temperature, where the trip temperature may often range from room temperature or above, the polymer matrix may expand and disrupt the electrically conductive network, rendering the composite much less electrically conductive. This change in resistance imparts a fuse-like character to the PPTC materials, which resistance may be reversible when the PPTC material cools back to room temperature.

For proper functioning, when operating in a low temperature state below the trip temperature, little of no change in resistance of the PPTC device may be useful. A property that is termed thermal derating characterizes the resistance behavior of a PPTC device in the low temperature state, where thermal derating measures the change in trip current or the change in resistance as a function of temperature in the low temperature state. While the tripping of PPTC device to a high resistance state is characterized by a melting or glass transition of the polymer matrix, in the low temperature state below the melt transition, the polymer matrix may also expand as a function of increasing temperature. This expansion is a characteristic of the thermal properties of the polymer matrix, and may cause an increase in electrical resistance as conductive filler particles become separated, leading to thermal derating. For an ideal PPTC device, a low thermal derating may be called for where little change in resistance or trip current takes place with increased temperature below the trip temperature. With respect to these and other considerations, the present disclosure is provided.

BRIEF SUMMARY

In one embodiment, a polymer positive temperature coefficient (PPTC) assembly is provided. The PPTC assembly may include a PPTC component, having a trip temperature, and further comprising a first temperature coefficient of resistance, in a low temperature range below the trip temperature. The PPTC assembly may include a resistive component, disposed in electrical contact with the PPTC component on a first side of the PPTC component, the resistive component comprising an electrical conductor, and having a second temperature coefficient of resistance in the low temperature range, less than the first temperature coefficient of resistance. The PPTC component may include a first electrode, electrically coupled to the first side of the PPTC component, and a second electrode, electrically coupled to the second side of the PPTC component. As such, the PPTC component and the resistive component are arranged in electrical series between the first electrode and the second electrode.

In another embodiment, a method may include choosing a PTC component having a targeted trip temperature, and a first room temperature resistance. The method may further include choosing a resistive component having a second room temperature resistance, wherein a sum of the first room temperature resistance plus the second room temperature resistance equals a target room temperature resistance. The method may include affixing the resistive component to the PTC component to form a PPTC to form a PPTC device, and attaching a set of electrodes to the PPTC device.

DESCRIPTION OF EMBODIMENTS

Figure 1A:
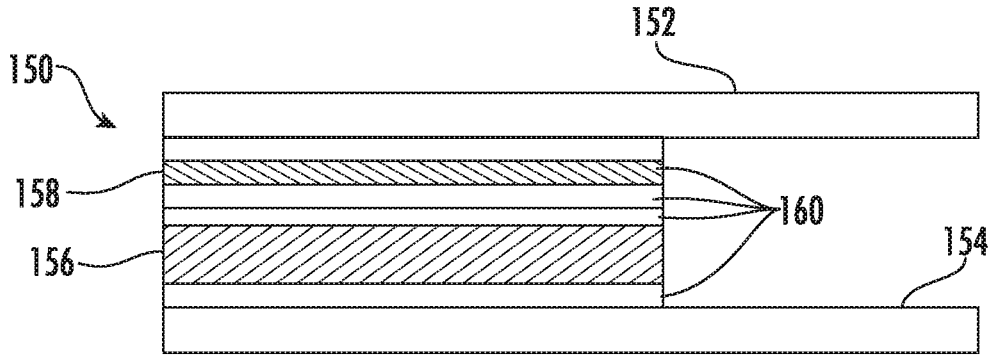
FIG. 1A depicts a side cross-sectional view of a PPTC device, according to embodiments of the disclosure.

The present embodiments will now be described more fully hereinafter with reference to the accompanying drawings, in which exemplary embodiments are shown. The embodiments are not to be construed as limited to the embodiments set forth herein. Rather, these embodiments are provided so that this disclosure will be thorough and complete, and will fully convey their scope to those skilled in the art. In the drawings, like numbers refer to like elements throughout.

In the following description and/or claims, the terms "on," "overlying," "disposed on" and "over" may be used in the following description and claims. "On," "overlying," "disposed on" and "over" may be used to indicate that two or more elements are in direct physical contact with one another. Also, the term "on,", "overlying," "disposed on," and "over", may mean that two or more elements are not in direct contact with one another. For example, "over" may mean that one element is above another element while not contacting one another and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

The present embodiments present PPTC devices that improve on the electrical characteristics of PPTC devices at temperatures below the melting temperature of the polymer material of a PPTC matrix. In the embodiments of the present disclosure a resistive component is added in electrical series with a PTC component, to create a static resistance component to the PPTC device, leading to lowering the PPTC resistance portion to provide better resistance stability below the PPTC trip temperature.

In some embodiments, a resistive load layer may be added to a PPTC layer to improve the characteristic of the thermal properties of the polymer matrix of the PPTC device before melting, where known devices exhibit an increase in electrical resistance as conductive filler particles become separated, leading to thermal derating. In accordance with specific embodiments of the disclosure, a resistance load component may be arranged in a layer separate from a PPTC layer.

FIG. 1A depicts a side cross-sectional view of a PPTC device 150, according to embodiments of the disclosure. In this embodiment, the PPTC device 150 includes a PPTC layer 156 (shown as PTC layer), where the PPTC layer 156 may include known components including a polymer matrix, and a conductive filler, disposed in the polymer matrix to generate switching from a low resistance state to a high resistance state at a given trip temperature.

The PPTC device 150 further includes a resistive component, shown as a resistance load layer 158, disposed adjacent to the PPTC layer 156. The resistance load layer 158 may include a material such as a thin resistor material, a metal thin film resistor, a ceramic metal oxide resistor, a coil resistor, a conductive polymer composite, including a conductive epoxy resin or a conductive epoxy. The embodiments are not limited in this context. In various non-limiting embodiments, the thickness of the PPTC layer 156 may range from 25 μm to 2000 μm, while the resistance of the resistance load layer 158 may range between 1 mOhm to 1000 Ohm.

As shown, the PPTC layer 156 and the resistance load layer 158 are disposed in electrical series, between a first terminal 152 and a second terminal 154 of the PPTC device 150. The first terminal 152 and the second terminal 154 may be copper or other suitable metal in some embodiments. The PPTC device 150 may also include various metal foil layers, arranged in electrical series between the first terminal 152 and the second terminal 154. In the embodiment shown, a plurality of foil layers are illustrated as foil layers 160. As an example, the resistance load layer 158 may be laminated with a nickel foil layer on the top surface and the bottom surface of the resistance load layer 158. The PPTC layer 156 may also be laminated with a nickel foil layer on the top surface and the bottom surface of the PPTC layer 156.

Figure 1B:
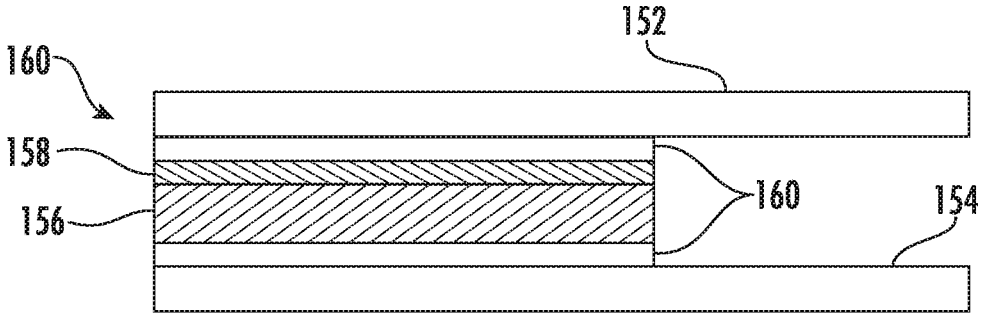
FIG. 1B depicts a side cross-sectional view of another PPTC device, according to embodiments of the disclosure.
Figure 1C:
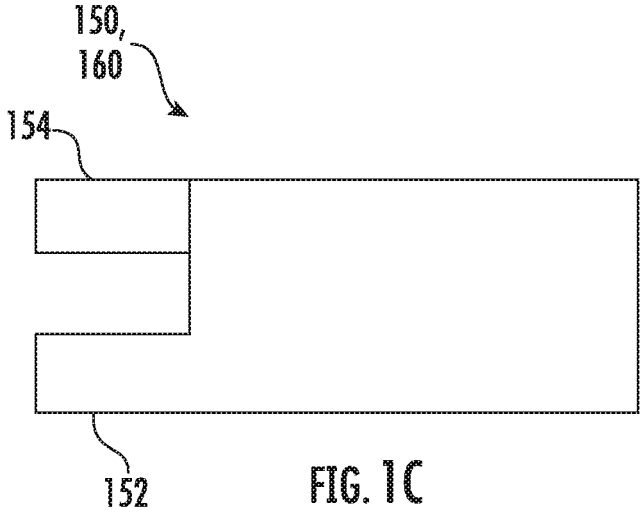
FIG. 1C depicts a top view of the PPTC device of FIG. 1A.

In an alternative embodiment, shown as PPTC device 160, in FIG. 1B, the resistance load layer 158 is arranged in direct contact with the PPTC layer 16, so just two metal foil layers are used, at the interface with the first terminal 152 and the second terminal 154. FIG. 1C depicts a top view of the PPTC device of FIG. 1A or of FIG. 1B.

In the embodiments of FIG. 1A and FIG. 1B, because the PPTC layer 156 and the resistance load layer 158 are arranged in electrical series, the overall electrical resistance between the first terminal 152 and the second terminal 154 is determined by the individual resistance of the PPTC layer 156 and the resistance load layer 158.

Figure 2:
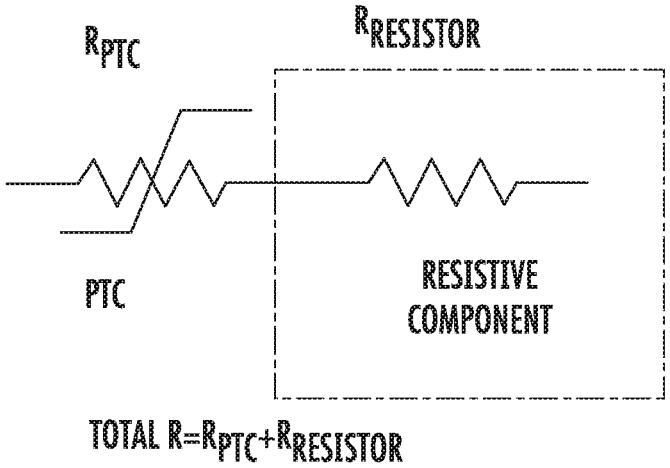
FIG. 2 depicts a circuit representation of PPTC devices according to the present embodiments.

To further explain operation of the novel PPTC devices, FIG. 2 depicts a circuit representation of PPTC devices according to the present embodiments. In FIG. 2, a PPTC device is electrically coupled between a terminal T1 and terminal T2, which terminals may be deemed to be electrodes, electrical leads, and so forth. The PPTC layer or component is in electrical series with a resistive component, such as a resistive load layer. The total resistance R, produced by the PPTC device is a sum of the resistance of the PPTC component $R_{PTC}$ and the resistance of the resistive component $R_{resistor}$, where the resistive component may be any of the aforementioned materials/components for the resistance load layer 158. By proper engineering of the resistance of the resistive component, the overall electrical behavior of a PPTC device that includes the PPTC layer and resistive component may be tailored, for example, to provide resistance stability in the low temperature regime, below the trip temperature of the PPTC layer, as detailed below.

Figure 3:
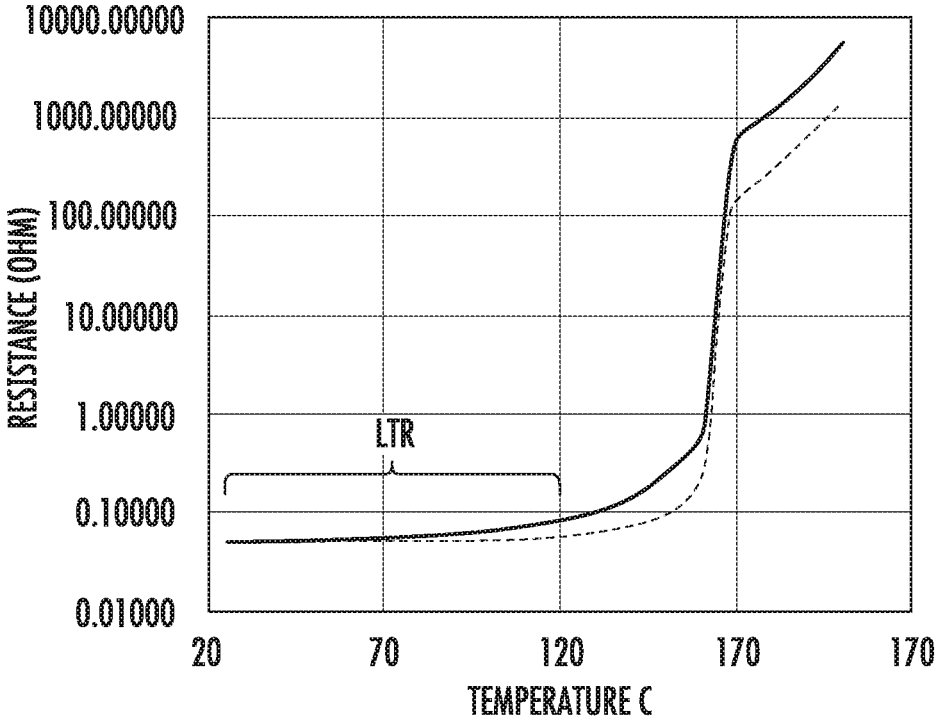
FIG. 3 depicts a graph showing electrical resistance as a function of temperature for a PPTC device according to embodiments of the disclosure, and a conventional device.
Figure 4:
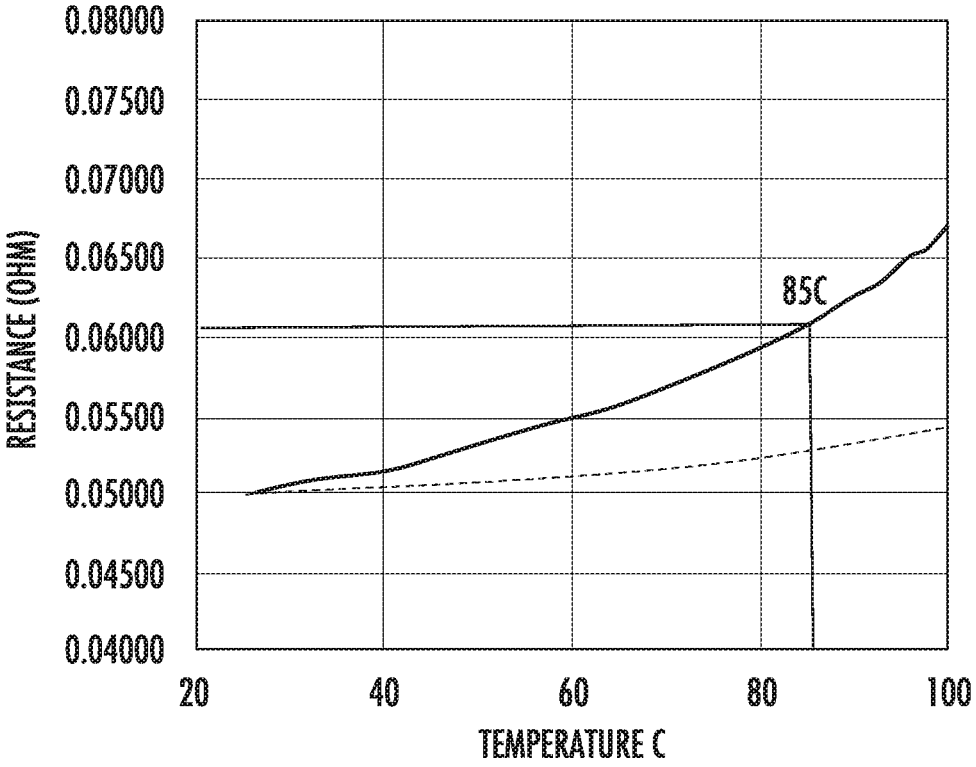
FIG. 4 depicts a low temperature portion of the graph of FIG. 3.

FIG. 3 depicts a graph showing electrical resistance as a function of temperature for a PPTC device according to embodiments of the disclosure, and a conventional device; FIG. 4 depicts a low temperature portion of the graph of FIG. 3. As shown in the graphs, a conventional PPTC material (solid line), without the added resistive component, exhibits a greater increase in electrical resistance below the trip temperature (trip temperature ~160° C.), as compared to the PTC device of the present embodiments, with the added resistive component (dashed line). By adding a static resistive component, the thermal derating, as indicated by the increased resistance, is much less at 85° C., for example.

To explain the advantages of the present embodiments further, consider the scenario where the behavior illustrated in FIG. 3 and FIG. 4 is generated in the following manner. A PPTC product's requirement is to exhibit 50 mOhm resistance in the low temperature range. In principle, maintaining this level of resistance at all temperatures ° below the trip temperature is most desirable. In practice, at 25° C. the PPTC resistance $R_{25C}$ may equal 50 mOhm, while at 85° C., the PPTC resistance R85C=60 mOhm, as shown in FIG. 4. Thus, the ratio of resistance at 85° C. compared to resistance at 25° C., $R_{85C}/R_{25C}$=1.2×. In other words, resistance has increased 25% over that temperature range. In accordance with embodiments of the disclosure, the same resistance may be generated by arranging the same PPTC material, such as a PPTC layer, and a resistive component, such as a resistive layer, in electrical series, where the PPTC layer has a resistance of 12.5 mOhm and the resistive component has a resistance of 37.5 mOhm, for a total resistance of 50 mOhm. At 85° C., the PPTC layer will increase its resistance by 25% to yield an R85C of 15 mOhm, while the resistive component, having a static resistance, maintains a resistance of 37.5 mOhm, for a total resistance at 85 C of 52.5 mOhm. Thus, $R_{85C}/R_{25}$=52.5 mOhm/50 mOhm or 1.05, a much lower increase in total resistance than the known device, formed just from the PPTC material.

More generally, and with reference to FIG. 3 and FIG. 4, within a given temperature range, labeled LTR if FIG. 3, the PPTC component of the present embodiments may be deemed to have a first temperature coefficient of resistance (TCR), while the resistive component may be deemed to have a second temperature coefficient of resistance, less than the first temperature coefficient of resistance. Notably, the TCRs need not be linear with temperature, and may be defined simply by the resistance and two different temperatures of interest T2 and T1), such as 25° C. and 85° C., where the TCR would be given by $R_{T2}/R_{T1}/(T2-T1)$. Thus, by providing a resistive component with a lower TCR, in electrical series with a PPTC component with a relatively higher TCR, the effective TCR of the PPTC device assembly may be lowered with respect to a pure PPTC device without the resistive component, leading to a lesser thermal derating. Said differently, the TCR of the resistive component need not be zero in some embodiments to effectively reduce the TCR of the PPTC device assembly, but may be a lesser value than the TCR of the PPTC component or layer.

Figure 5:
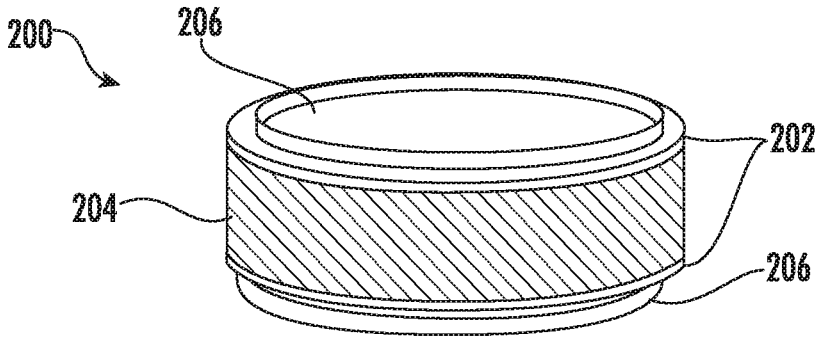
FIG. 5 depicts an embodiment of a PPTC device according to further embodiments of the disclosure.

FIG. 5 depicts an embodiment of a PPTC device according to further embodiments of the disclosure. The PPTC device 200 has a cylindrical disc shape, including a pair of resistive components, shown as resistive layers 202, and a PPTC layer 204, disposed between the resistive layers 202. The PPTC device 200 may be coupled to outside terminals, or electrodes, shown as electrodes 206, for example. Notably, in other embodiments, a resistive component need just be provided as one layer, on either side of the PPTC layer 204.

Figure 6:
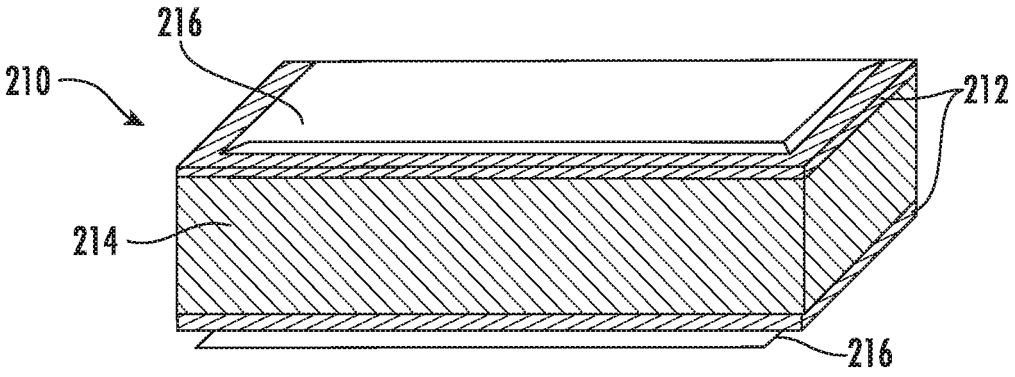
FIG. 6 depicts an embodiment of a PPTC device according to further embodiments of the disclosure.

FIG. 6 depicts an embodiment of a PPTC device according to further embodiments of the disclosure. The PPTC device 210 has a rectangular prism shape (rectangular disc shape), including a pair of resistive components, shown as resistive layers 212, and a PPTC layer 214, disposed between the resistive layers 212. The PPTC device 210 may be coupled to outside terminals, or electrodes, shown as electrodes 216. Notably, in other embodiments, a resistive component need just be provided as one layer, on either side of the PPTC layer 214.

Figure 7:
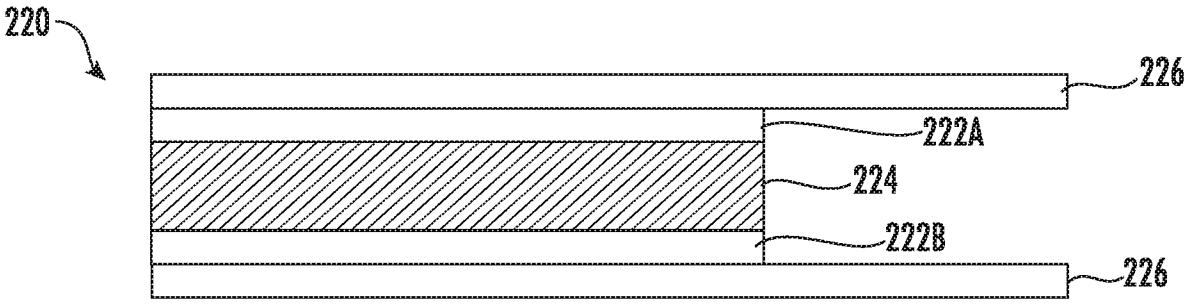
FIG. 7 depicts an embodiment of a PPTC device assembly according to further embodiments of the disclosure.

FIG. 7 depicts an embodiment of a PPTC device assembly according to further embodiments of the disclosure. The PPTC device assembly 220 includes a pair of resistive components, shown as resistive layers 222A and 222B, and a PPTC layer 224, disposed between the resistive layers. The PPTC device assembly 220 also includes electrodes 226, as shown, where the PPTC layer 224, resistive layer 222A, and resistive layer 222B are disposed in electrical series between the electrodes 226. The electrodes 226 extend parallel to the plane of the PPTC layer 224 along the same direction. Notably, in other embodiments, a resistive component need just be provided as one layer, on either side of the PPTC layer 224.

Figure 8:
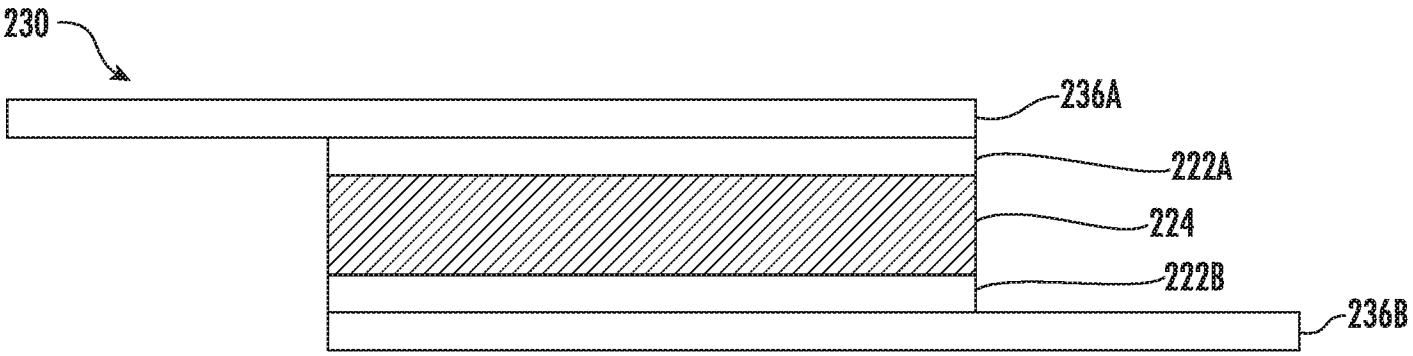
FIG. 8 depicts an embodiment of a PPTC device assembly according to further embodiments of the disclosure.

FIG. 8 depicts an embodiment of a PPTC device assembly according to further embodiments of the disclosure. The PPTC device assembly 230 includes a pair of resistive components, shown as resistive layers 222A and 222B, and the PPTC layer 224, disposed between the resistive layers. The PPTC device assembly 230 also includes an electrode 236A and electrode 236B, as shown, where the PPTC layer 224, resistive layer 222A, and resistive layer 222B are disposed in electrical series between the electrode 236A and electrode 236B. The electrode 236A and electrode 236B extend parallel to the plane of the PPTC layer 224 along opposite directions. Notably, in other embodiments, a resistive component need just be provided as one layer, on either side of the PPTC layer 224.

In various embodiments, a PPTC assembly may be constructed, where the PPTC layer includes a polymer matrix, and includes a conductive filler, dispersed therein. The polymer matrix may be formed of any suitable polymer for forming a PPTC device, as known in the art. In some embodiments, the polymer matrix may be formed from a polyolefin, such as polyethylene (PE), low density polyethylene (LDPE), high density polyethylene (HDPE), an ethylene tetrafluoroethylene copolymer (ETFE), polytetrafluoroethylene (PTFE), polychlorotrifluoroethylene, perfluoroalkoxy alkane, or tetrafluoroethylene-perfluoropropylene, polyvinylidene fluoride, other fluoropolymer or other fluorine-containing polymer. The embodiments are not limited in this context.

In various embodiments, the conductive filler may be a metal filler, including nickel, copper; a carbon filler, such as carbon black or graphite, a conductive ceramic filler, such as tungsten carbide, or titanium carbide. The embodiments are not limited in this context. Through shown as round particles, the conductive filler may include particles of any appropriate shape including equiaxed shapes, elongated shapes, and irregular shapes. According to various embodiments, the volume fraction of the conductive filler may be arranged at a sufficiently high level to impart relatively low electrical resistance or electrical resistivity between a first surface and a second surface, opposite the first surface. Depending upon the composition of the conductive filler and the shape of the particles of the conductive filler, the volume fraction of the conductive filler 104 may range from 5% to 60%.

Figure 9:
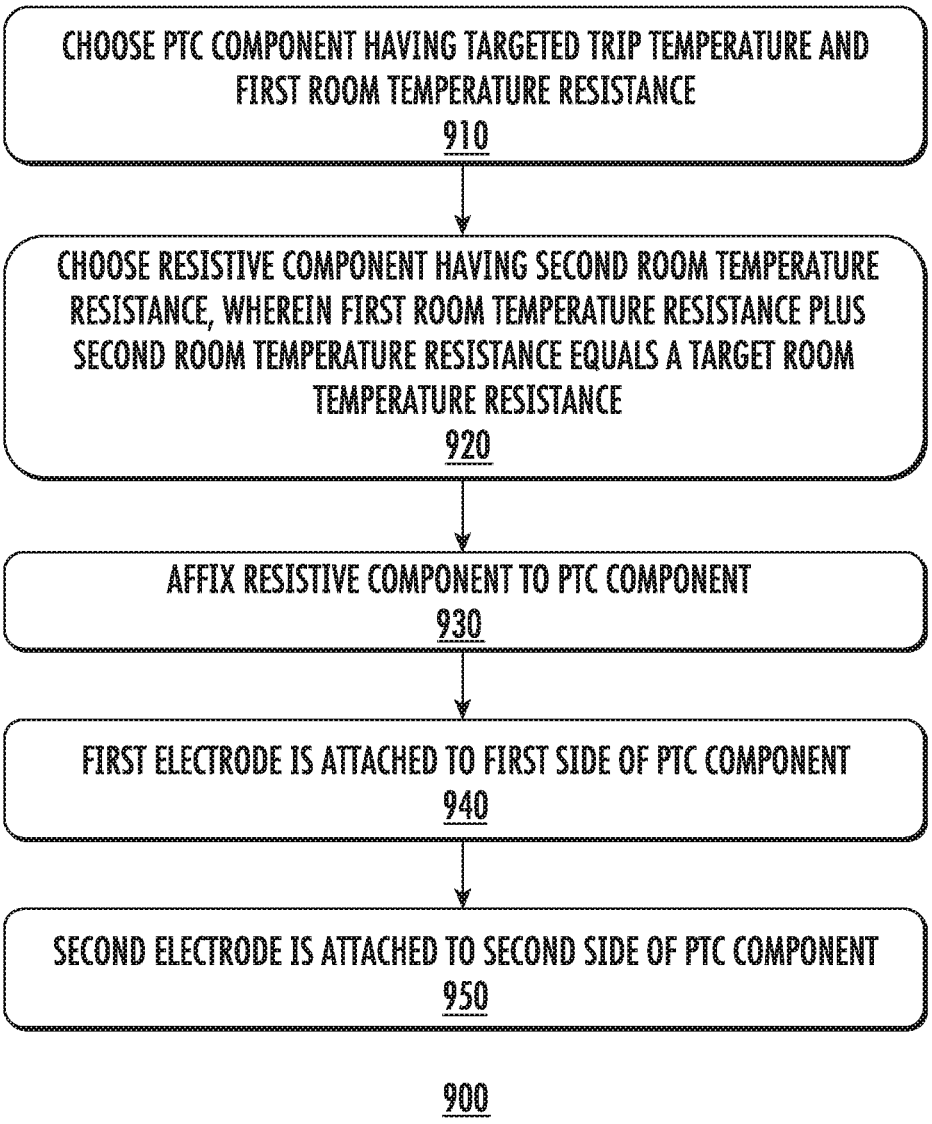
FIG. 9 depicts an embodiment of a process flow.

FIG. 9 depicts a process flow 900, according to embodiments of the disclosure. At block 910, a PTC component is selected to exhibit a targeted trip temperature (such as between 100° C. and 200° C. in various non-limiting embodiments), as well as a first room temperature (25° C.) resistance. The PTC component may exhibit a characteristic increase in resistance over a temperature range below the trip temperature, such as over a 25° C.-85° C. temperature range, or over a 25° C.-100° C. temperature range, in various non-limiting embodiments.

At block 920, a resistive component is chosen to exhibit a second room temperature resistance. In some examples, the second room temperature resistance may be higher than the first room temperature resistance of the PTC component. The sum of the first room temperature resistance and the second room temperature resistance may be chosen to equal a target room temperature series resistance.

At block 930, the resistive component is affixed to the PTC component. In some examples, the PTC component may be configured as a layer, a block a slab, a thin cylinder, or other shape. The resistive component may be affixed to the PTC component using an electrically conductive medium, such as solder in some embodiments. In some embodiments, the resistive component may take the form of a thin sheet or a foil. In other embodiments, the resistive component may be a conductive polymer, such as a conductive epoxy. According to various embodiments, the resistive component may be selected to have a flat resistance behavior over a low temperature regime, below the trip temperature of the PTC component. In some embodiments, the resistance of the resistive component may remain essentially constant over a temperature range, such as 25° C.-85° C., 25° C.-100° C., and so forth. Accordingly, over a targeted temperature range, such as 25° C. to 85° C., the resistive component and PTC component form a PPTC device exhibiting a lesser increase in series resistance as compared to a pure PTC device without the resistive component.

In some embodiments, the resistive component may be provided as two layers or sheets, affixed to opposite sides of a PTC component, arranged in any useful shape.

At block 940 a first electrode is attached to a first side of the PTC component, either directly, or being attached to a resistive component that is attached directly to the PTC component.

At block 950, a second electrode is attached to a second side of the PTC component, either directly, or being attached to a resistive component that is attached directly to the PTC component.

In other embodiments, a known surface mount type of PPTC component arranged in a surface mount device, may be placed in electrical series with a resistive component such as a resistive load layer to reduce the thermal derating of the PPTC component.

While the present embodiments have been disclosed with reference to certain embodiments, numerous modifications, alterations and changes to the described embodiments are possible while not departing from the sphere and scope of the present disclosure, as defined in the appended claims. Accordingly, the present embodiments are not to be limited to the described embodiments, and may have the full scope defined by the language of the following claims, and equivalents thereof.

What is claimed is:

1. A polymer positive temperature coefficient (PPTC) assembly, comprising:

a PPTC component, the PPTC component comprising a trip temperature, and further comprising a first temperature coefficient of resistance, in a low temperature range below the trip temperature;

and a resistive component, disposed in electrical contact with the PPTC component on a first side of the PPTC component, the resistive component comprising an electrical conductor, and having a second temperature coefficient of resistance in the low temperature range, less than the first temperature coefficient of resistance;

a first electrode electrically coupled to the resistive component; and a second electrode electrically coupled to a second side of the PPTC component, wherein the PPTC component and the resistive component are arranged in electrical series between the first electrode and the second electrode.

2. The PPTC assembly of claim 1, wherein the resistive component comprises a thin resistor material, a metal thin film resistor, a conductive polymer composite, a ceramic metal oxide resistor, a coil resistor, an epoxy resin or a conductive epoxy.

3. The PPTC assembly of claim 1, wherein the PPTC component comprises a polymer matrix, and a conductive filler, disposed in the polymer matrix to generate switching from a low resistance state to a high resistance state at the trip temperature.

4. The PPTC assembly of claim 3, wherein the polymer matrix comprises polyethylene (PE), low density polyethylene (LDPE), high density polyethylene (HDPE), an ethylene tetrafluoroethylene copolymer (ETFE), polytetrafluoroethylene (PTFE), polychlorotrifluoroethylene, perfluoroalkoxy alkane, tetrafluoroethylene-perfluoropropylene, polyvinylidene fluoride, other fluoropolymer or other fluorine-containing polymer.

5. The PPTC assembly of claim 1, wherein the PPTC component comprises a first resistance at room temperature, as measured between the first electrode and the second electrode, and wherein the resistive component comprises a second resistance at room temperature, as measured between the first electrode and the second electrode, the second resistance being greater than the first resistance.

6. The PPTC assembly of claim 5, wherein the second resistance is at least twice the first resistance.

7. The PPTC assembly of claim 1, wherein the resistive component and the PPTC component comprise a cylindrical disc shape or a rectangular disc shape.

8. The PPTC assembly of claim 1, wherein the first electrode and the second electrode extend in opposite directions, parallel to a plane of the PPTC component.

9. The PPTC assembly of claim 1, comprising a surface mount device.

10. The PPTC assembly of claim 9, the surface mount device comprising a double layer surface mount device.

11. A method, comprising:

providing a PTC component having a trip temperature, a first room temperature resistance, and a first temperature coefficient of resistance in a low temperature range below the trip temperature;

providing a resistive component having a second room temperature resistance, wherein a sum of the first room temperature resistance and the second room temperature resistance equals a target room temperature resistance, the resistive component having a second temperature coefficient of resistance in the low temperature range less than the first temperature coefficient of resistance;

affixing the resistive component to the PTC component to form a PPTC device; and attaching a set of electrodes to the PPTC device.

12. The method of claim 11, wherein the resistive component comprises a thin resistor material, a metal thin film resistor, a conductive polymer composite, an epoxy resin or a conductive epoxy.

13. The method of claim 11, wherein the PTC component comprises a polymer matrix, and a conductive filler, disposed in the polymer matrix to generate switching from a low resistance state to a high resistance state at the trip temperature.

14. The method of claim 13, wherein the polymer matrix comprises polyethylene (PE), low density polyethylene (LDPE), high density polyethylene (HDPE), an ethylene tetrafluoroethylene copolymer (ETFE), polytetrafluoroethylene (PTFE), polychlorotrifluoroethylene, perfluoroalkoxy alkane, tetrafluoroethylene-perfluoropropylene, polyvinylidene fluoride, other fluoropolymer or other fluorine-containing polymer.

15. The method of claim 11, wherein the set of electrodes comprises a first electrode and a second electrode, wherein the PTC component comprises a first resistance at room temperature, as measured between the first electrode and the second electrode, and wherein the resistive component comprises a second resistance at room temperature, as measured between the first electrode and the second electrode, the second resistance being greater than the first resistance.

16. The method of claim 15, wherein the second resistance is at least twice the first resistance.

* * * * *